United States Patent [19]

Shaw et al.

[11] Patent Number: 4,673,315

[45] Date of Patent: Jun. 16, 1987

[54] APPARATUS FOR RAISING AND SUPPORTING A BUILDING

[76] Inventors: Robert R. Shaw, 908 Elmwood Dr., Edmond, Okla. 73034; Steven D. Gregory, 301 E. Main, Ada, Okla. 74820

[21] Appl. No.: 766,775

[22] Filed: Aug. 16, 1985

[51] Int. Cl.[4] ..... E02D 17/02

[52] U.S. Cl. ..... 405/230; 405/229

[58] Field of Search ..... 405/230, 199, 229, 231; 254/29 R; 52/298, 726, 236, 126, 127

[56] References Cited

U.S. PATENT DOCUMENTS

| | | | |
|---|---|---|---|
| 2,982,103 | 5/1961 | Revesz et al. | 405/230 |
| 3,796,055 | 3/1974 | Mahony | 405/230 |
| 3,852,970 | 12/1974 | Cassidy | 405/230 |
| 3,902,326 | 9/1975 | Langenbach | 405/230 |
| 4,012,917 | 3/1977 | Gendron | 405/199 |
| 4,070,867 | 1/1978 | Cassidy | 405/230 X |

FOREIGN PATENT DOCUMENTS

| | | | |
|---|---|---|---|
| 1418164 | 12/1975 | United Kingdom | 405/230 |

*Primary Examiner*—Dennis L. Taylor
*Attorney, Agent, or Firm*—Warren B. Kice

[57] ABSTRACT

An apparatus for raising and supporting the foundation or slab of a building in which a lifting assembly is inserted underneath the foundation or slab and is adapted to receive a pipe assembly. A clamping assembly is provided for engaging a portion of the pipe assembly extending above the lifting assembly, and a hydraulic system extends between the lifting assembly and the clamping assembly for sequentially lowering the pipe assembly into the ground so that, when it encounters resistance, the foundation or slab is supported and can be raised to a predetermined level.

7 Claims, 5 Drawing Figures

APPARATUS FOR RAISING AND SUPPORTING A BUILDING

BACKGROUND OF THE INVENTION

This invention relates to an apparatus and method for raising and supporting a building, and more particularly to such an apparatus and method in which pilings are used to support the foundation or concrete slab of a building.

Houses and other buildings are often erected on foundations or concrete slabs which are not in direct contact with load supporting underground strata, such as bedrock, or the like. If not initially constructed properly, or if soil conditions change, the foundation footing may settle, causing the foundation or slab to sag and/or crack. Unless the building is supported, or shored, continued settling may result in major structural damage or collapse of the building.

There have been several suggestions in the prior art for raising and supporting the foundation or slab of a building of this nature. For example, according to one technique the foundation or slab is lifted, or jacked up, and pilings are inserted underneath to support same. However, the pilings are often not directly supported on the bedrock, resulting in continued settling after the pilings are in place. Also, these techniques often require extensive evacuation of the basement flooring for placing the pilings under the foundation walls, which is expensive. Further, in many instances, the pilings are visible above the basement floor.

In still other prior art techniques utilizing pilings, a single hydraulically actuated system is used for each piling, requiring the use of a relatively high pressure hydraulic system, which is expensive and cumbersome to use. Also if the pilings are lifted individually, the structure of the foundation or slab becomes uneven which causes additional potential problems.

SUMMARY OF THE INVENTION

It is therefore an object of the present invention to provide an apparatus and method for supporting and raising a foundation or slab in which pilings are inserted between the lower surface of the foundation or slab and are supported directly on bedrock.

It is still further object of the present invention to provide an apparatus and method of the above type in which the pilings are relatively strong and invisible after the method is completed.

It is a still further object of the present invention to provide an apparatus and method of the above type, which requires minimum evacuation of the ground surrounding the foundation or slab.

It is a still further object of the present invention to provide an apparatus and method of the above type in which a pair of hydraulic systems operate in tandem with each piling assembly.

It is a still further object of the present invention to provide an apparatus of the above type in which all of the piling assemblies associated with the particular foundation or slab are raised at once.

Toward the fulfillment of these and other objects, the apparatus of the present invention includes a lifting arm assembly for engaging the lower surface of the foundation or slab, and a pipe assembly extending through guide means associated with the lifting arm assembly and having an upper portion extending above the guide means and a lower portion extending into the ground. A clamp extends around the upper portion of the pipe assembly and two hydraulic ram assemblies extend to either side of the pipe assembly. The respective ends of each ram assembly are connected to the lifting arm assembly and the clamp and the ram assemblies are actuated to drive the pipe assembly into the ground.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
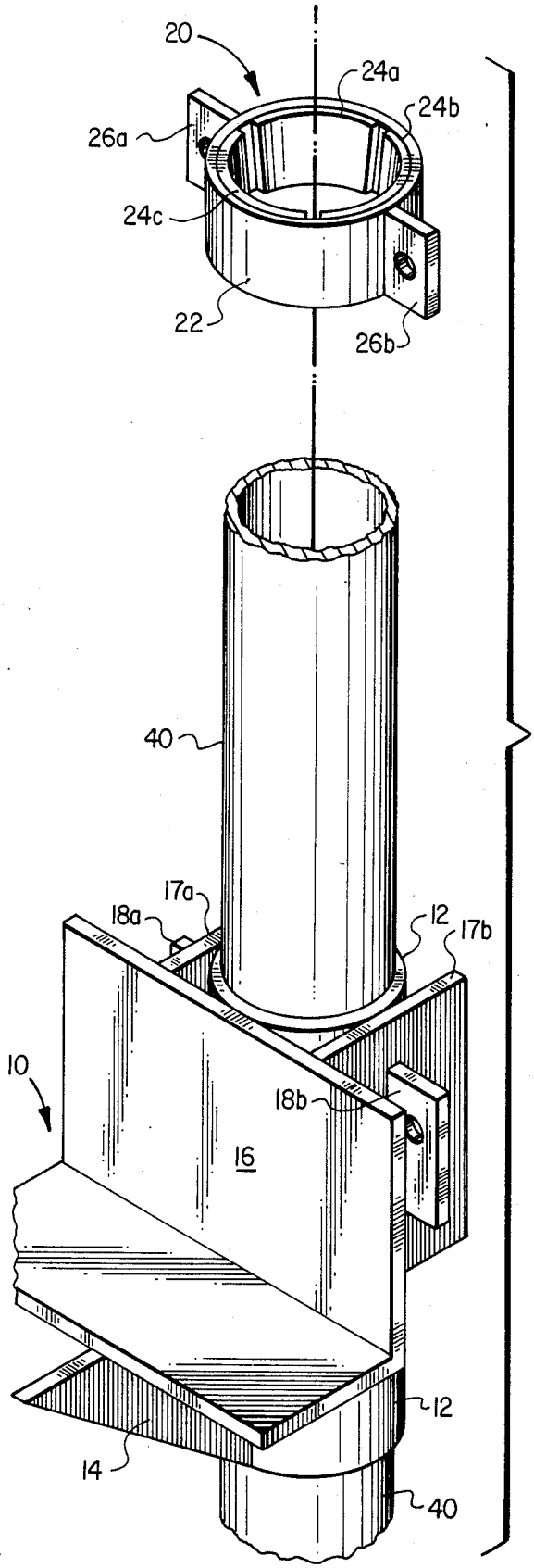
FIG. 1 is a perspective view showing the lifting arm assembly and the clamping assembly of the apparatus of the present invention.

Referring specifically to FIG. 1, the reference numeral 10 refers in general to the lifting arm assembly of the present invention which comprises a sleeve 12 having a lifting arm 14 welded to the outer surface thereof. An L-shaped bracket 16 is welded to the outer surface of the sleeve and the upper surface of the arm 14, and a pair of plates 17*a* and 17*b* are connected to, and extend perpendicular to, the outer surface of one leg of the bracket.

A pair of mounting plates 18*a* and 81*b* are connected to and extend perpendicular to the plates 17*a* and 17*b* and each has an opening extending therethrough.

A clamping assembly, shown in general by the reference numeral 20, is provided and includes an outer ring 22 and three inner arcuate inserts 24*a*, 24*b*, and 24*c*. The inserts 24*a*, 24*b*, and 24*c* are tapered in a vertical direction so that they will grab, or engage, a pipe segment of a predetermined diameter during downward movement and slide over the pipe segment during upward movement in a conventional manner.

A pair of mounting plates 26*a* and 26*b* are connected to and extend from diametrically opposite portions of the ring 22 and each has an opening extending therethrough.

A pair of hydraulic ram units 30*a* and 30*b* are provided which are installed between the respective plates 18*a* and 18*b* of the lifting arm assembly 10 and the plates 26*a* and 26*b* of the clamping assembly 20. A pair of arms 32*a* and 32*b* extend from the ram units 30*a* and 30*b*, it being understood that they are connected to pistons which reciprocate in the ram units in response to actuation of the units in a conventional manner. This reciprocal movement of the pistons causes corresponding movement of the arms 32*a* and 32*b* between the extended position shown in FIG. 2 and a retracted position.

A pair of clevises 34*a* and 34*b* are connected to the end of the stems 32*a* and 32*b* , extend over the plates 26*a* and 26*b* and are connected to the latter plates by a pair of bolts. In a similar manner, a pair of clevises 36*a* and 36*b* are connected to the respective ends of the ram units 30*a* and 30*b*, extend over the plates 18*a* and 18*b* and are connected to the latter plates by a pair of bolts.

Figure 2:
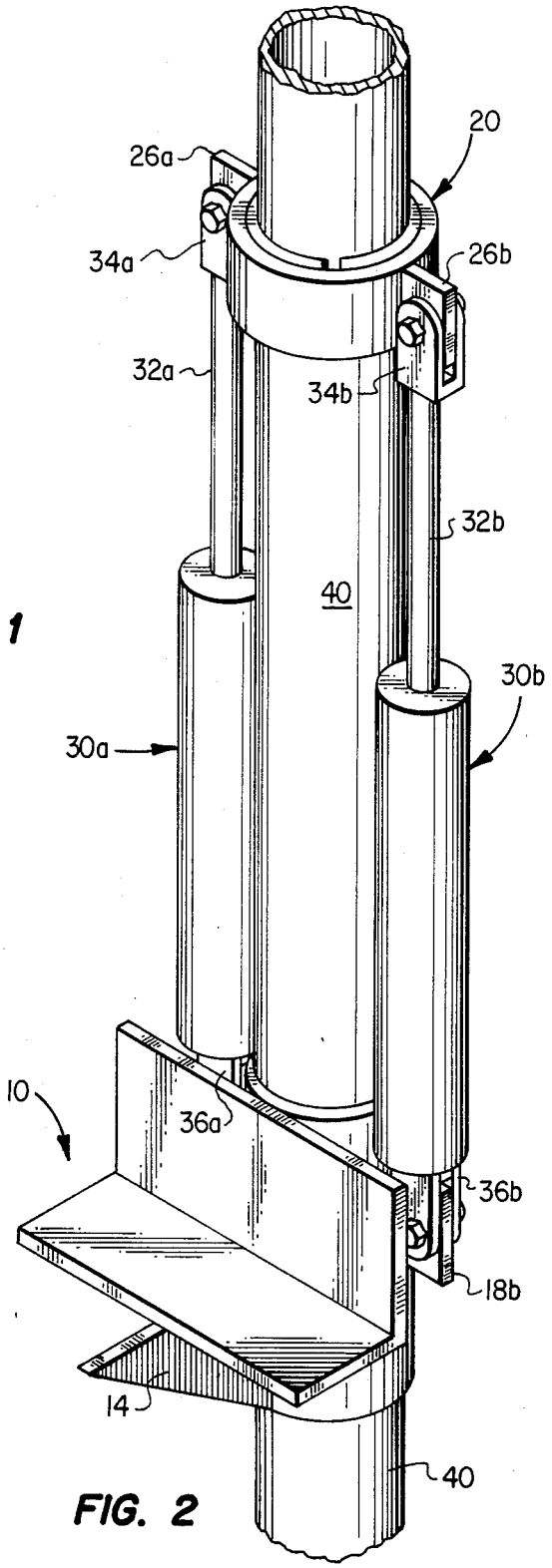
FIG. 2 is a perspective view of the apparatus of the present invention.

A pipe assembly, shown in general by the reference numeral 40, and comprising a plurality of pipe segments, extends through the sleeve 12 of the lifting arm assembly 10 and through the clamping assembly 20 as shown in FIGS. 1 and 2. Due to the tapered configuration of the arcuate inserts 24*a*, 24*b* and 24*c*, the clamping assembly can be manually lifted upwardly on the pipe assembly 40 without encountering substantial resistance. After connection to the hydraulic ram units 30*a* and 30*b* and the actuation of same to move the clamping assembly 20 downward, the inserts 24*a*, 24*b* and 24*c* will grab the outer surface of the pipe assembly 40 and force it downwardly, as will be described in further detail later.

Figure 3A:
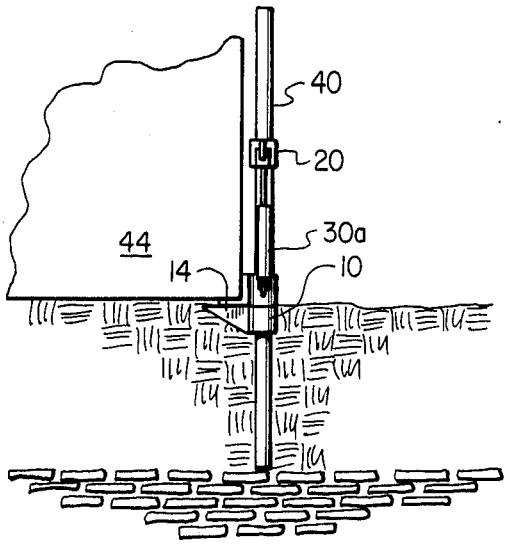
FIG. 3*a* is an elevational view showing the apparatus of FIG. 2 installed relative to the foundation or slab of the house.

The operation of the apparatus of the present invention will be described with reference to FIGS. 3*a* and 3*b* in connection with a house 44 having a corner that has a foundation failure causing a corresponding sinking of this portion of the house and thus requiring it to be raised, leveled and supported. The area around the corner of the foundation is initially evacuated and the lifting arm assembly 10 is placed in the evacuated area. Although only one assembly 10 is shown in the drawing it is understood that, in actual practice, several will be used, depending on the extent of the damage. The lifting arm 14 of each lifting arm assembly 10 is inserted underneath the house and against the lower surface of the foundation, as shown in FIG. 3*a*. A section of the pipe assembly 40 is then placed in the sleeve 12 of the lifting arm assembly 10, and the clamping assembly 20 is placed over the upper portion of the pipe assembly. The hydraulic ram units 30*a* and 30*b*, in their extended positions, are then installed between the respective plates 18*a* and 18*b* of the lifting arm assembly 10 and the plates 26*a* and 26*b* of the clamping assembly 20. The ram units 30*a* and 30*b* are actuated simultaneously to cause a retracting motion of their corresponding pistons, and therefore the arms 32*a* and 32*b*, to force the clamping assembly 20 downwardly. As a result, the clamping assembly 20 grabs the pipe assembly 40 and forces it downwardly into the ground for a predetermined distance. The ram units 30*a* and 30*b* are then simultaneously actuated back to their expanded condition, moving the clamping assembly 20 upwardly to an upper portion of the pipe assembly 40, and the sequence is repeated. During this sequential driving of the pipe assembly 40 into the ground, additional pipe segments may be added to the assembly 40 as needed.

The above procedure is repeated until the lower end portion of each pipe assembly 40 encounters resistance in the ground, which is usually in the form of bedrock or the like, in which case the aforementioned driving movement is terminated.

Figure 3B:
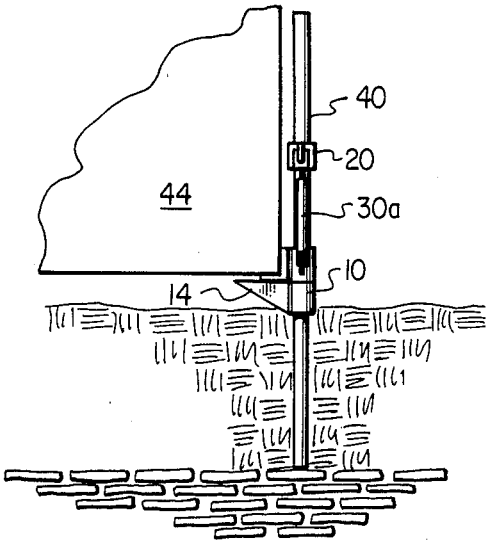
FIG. 3*b* is a view similar to FIG. 3*a*, but depicting the foundation after it has been raised.

After all of the pipe assemblies 40 have been driven into the ground in the foregoing manner until they encounter resistance, all of the ram units 30*a* and 30*b* associated with the pipe assemblies are simultaneously actuated again to raise the foundation, and therefore the house, a predetermined distance which can be approximately two to five inches as shown is FIG. 3*b*.

After the above raising is completed, that portion of each pipe's assembly 40 extending within the upper end of its corresponding sleeve 12 is welded to the sleeve and the ram units 30*a* and 30*b*, along with the clamping assemblies 20, are removed from the lifting arm assemblies 10. The pipe assemblies 40 are then cut at a point immediately above the weld between the pipe assembly 40 and the sleeve 12. The excavated area around each piling is then filled in and the procedure is complete.

Figure 4:
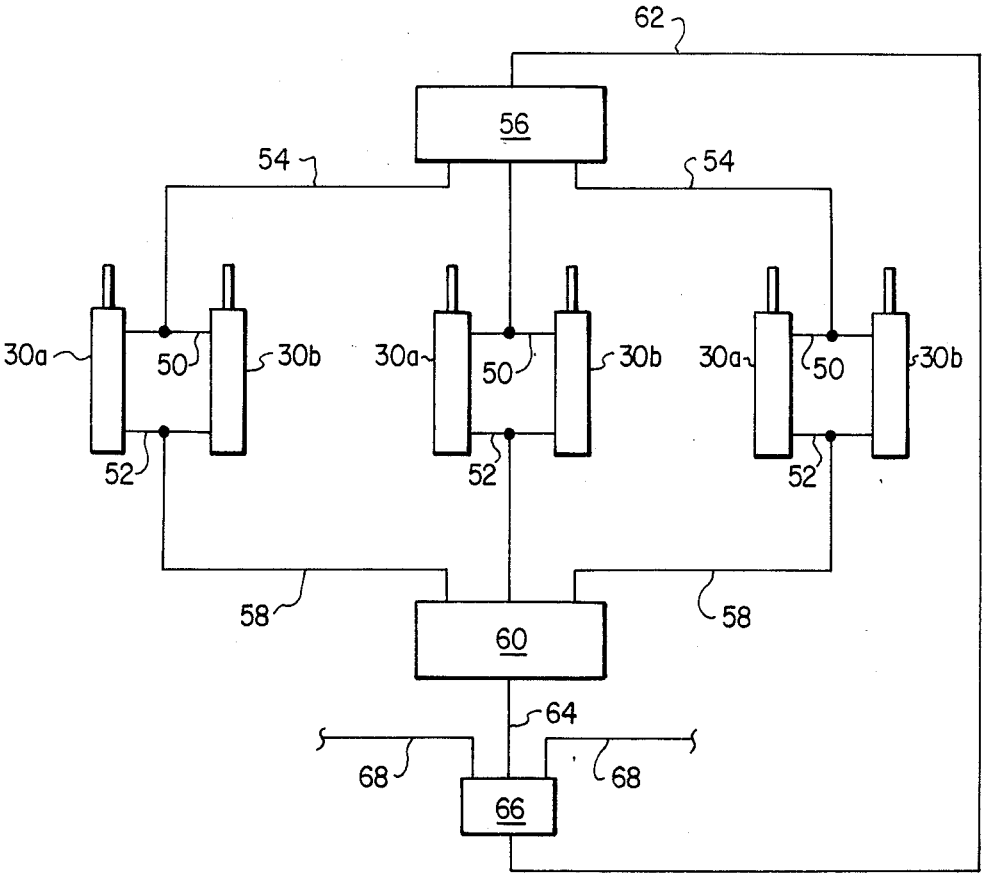
FIG. 4 is a schematic view showing the fluid flow circuit used in the apparatus of the present invention.

FIG. 4 shows a flow diagram for the ram units 30*a* and 30*b* described above. Three pairs of the ram units 30*a* and 30*b* are shown schematically in the drawing, with fluid lines 50 and 52 connecting the upper portions and the lower portions, respectively, of the units. It is understood that the fluid lines 50 and 52 feed fluid into the cylinder of their respective ram units 30*a* and 30*b* to cause corresponding movement of their pistons, in a conventional manner. The fluid lines 50 are connected, via lines 54, to a manifold 56; and the fluid lines 52 are connected, via lines 58, to a manifold 60.

The manifolds 56 and 60 are connected, via lines 62 and 64, respectively, to a pump, or compressor 66 which operates to selectively pump fluid into the manifold 56 and from the manifold 60 and, alternately, into the manifold 60 and from the manifold 56 depending on the particular stroke of the ram units 30*a* and 30*b*. Of course, when the pump flow is reversed, the fluid flow is reversed to cause movement of the piston portions of the hydraulic jack assemblies in the opposite direction.

Two additional lines 68 extend from the pump 66 which can feed a pair of manifolds (not shown), connected parallel to the manifold 66. As a result, a total of nine pairs of ram units identical to the units 30*a* and 30*b* can be actuated at one time in the event that the foundation damage is extensive and/or extends over a large area.

It is apparent from the foregoing that several advantages result from the apparatus of the present invention.

For example, the pilings formed according to the present invention are supported directly on bedrock, which adds stability to the supporting system. Also, the pilings are relatively strong and invisible after the method is completed even though only minimum excavation of the ground surrounding the foundation is required.

Further, the system of the present invention eliminates the need for high pressure ram devices, yet permits all of the piling assemblies associated with the particular foundation to be raised at once.

It is understood that, although the above example was described in connection with the foundation of a building, the system of the present invention can also be used in an identical manner to raise a concrete slab extending underneath the entire area of a building or a house. In the case of a concrete slab, the lifting arm assembly 10 is engaged adjacent an outer edge of the slab in a manner similar to shown in FIG. 3*a*. In the case of damage to, or sinking of, an internal portion of the slab, a hole can be formed through the damaged portion of the slab, the lifting arm assembly 10 can be inserted through the hole, and the arm 14 and bracket 16 rotated to extend underneath the slab. Then the lifting arm assembly 10 can be raised and the portion of the slab supported in the manner discussed above. Also, the lifting arm assembly 10 can be modified to provide a pair of diametrically opposed arms 14 and brackets 16 extending from the sleeve 12 to facilitate the lifting action of the arm assembly 10.

Other modifications, changes and substitutions are intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. An apparatus for raising and supporting the foundation or slab of a building, said apparatus comprising means for engaging the lower surface of said foundation or slab, said engaging means including a tubular guide means; a pipe assembly extending through said guide means and having an upper portion extending above said guide means and a lower portion extending into the ground; clamp means extending around said upper portion of said pipe assembly; and hydraulic ram means connected between said engaging means and said clamp means, respectively in the expanded position of ram assemblies; and means for actuating said ram means to retract same and drive said pipe assembly into the ground until said pipe assembly encounters a predetermined resistance, said actuating means adapted to further actuate said ram means after said predetermined resistance is encountered to raise said foundation or slab a predetermined distance.

2. The apparatus of claim 1 where said engaging means further comprises a mounting plate extending to either side of said guide means.

3. The apparatus of claim 2 wherein said engaging means further comprising at least one lifting arm extending outwardly from said guide means for extending underneath and engaging the lower surface of said foundation or slab.

4. The apparatus of claim 2 wherein said clamping assembly comprises a central portion extending around said upper pipe portion and a mounting plate extending to either side of said central portion.

5. The apparatus of claim 4 wherein the respective ends of each ram means are connected to the corresponding mounting plates of said engaging means and said clamp means, respectively.

6. The apparatus of claim 1 wherein said clamp means is adapted to clamp said pipe assembly upon downward movement relative thereto and to disengage said pipe assembly when forced upwardly relative thereto.

7. The apparatus of claim 1 wherein said pipe assembly is welded to said guide means in the raised position of said foundation or slab.

* * * * *